US007983909B2

(12) United States Patent
Budnikov et al.

(10) Patent No.: US 7,983,909 B2
(45) Date of Patent: Jul. 19, 2011

(54) METHOD AND APPARATUS FOR ENCODING AUDIO DATA

(75) Inventors: Dmitry N. Budnikov, Nizhny Novgorod (RU); Igor V. Chikalov, Nizhny Novgorod (RU); Sergey N. Zheltov, Nizhny Novgorod (RU)

(73) Assignee: Intel Corporation, Santa Clara, CA (US)

( * ) Notice: Subject to any disclaimer, the term of this patent is extended or adjusted under 35 U.S.C. 154(b) by 1231 days.

(21) Appl. No.: 10/571,331

(22) PCT Filed: Sep. 15, 2003

(86) PCT No.: PCT/RU03/00404

§ 371 (c)(1),
(2), (4) Date: Mar. 7, 2006

(87) PCT Pub. No.: WO2005/027096

PCT Pub. Date: Mar. 24, 2005

(65) Prior Publication Data

US 2007/0033024 A1 Feb. 8, 2007

(51) Int. Cl.
*G10L 21/00* (2006.01)

(52) U.S. Cl. ..... 704/229; 704/200; 704/222; 704/230

(58) Field of Classification Search ..... 704/200, 704/222, 229, 230

See application file for complete search history.

(56) References Cited

U.S. PATENT DOCUMENTS

| | | | | |
|---|---|---|---|---|
| 5,590,108 | A * | 12/1996 | Mitsuno et al. | 369/59.16 |
| 6,456,963 | B1 | 9/2002 | Araki | |
| 6,625,574 | B1 * | 9/2003 | Taniguchi et al. | 704/229 |
| 6,693,963 | B1 * | 2/2004 | Taniguchi | 375/240.11 |
| 6,986,096 | B2 * | 1/2006 | Chaudhuri et al. | 714/780 |
| 2003/0088400 | A1 * | 5/2003 | Nishio et al. | 704/201 |
| 2004/0165667 | A1 * | 8/2004 | Lennon et al. | 375/242 |
| 2004/0230425 | A1 * | 11/2004 | Yu et al. | 704/223 |

FOREIGN PATENT DOCUMENTS

| | | | |
|---|---|---|---|
| EP | 0967593 | A1 | 12/1999 |
| EP | 1085502 | A2 | 3/2001 |
| RU | 2185024 | C2 | 7/2002 |
| WO | 2005/027096 | A1 | 3/2005 |

OTHER PUBLICATIONS

International Search Report received from PCT Application No. PCT/RU2003/000404, mailed on May 20, 2004, 1 page.

* cited by examiner

*Primary Examiner* — Daniel D Abebe
(74) *Attorney, Agent, or Firm* — L. Cho

(57) ABSTRACT

A method for processing audio data includes determining a first common scalefactor value for representing quantized audio data in a frame. A second common scalefactor value is determined for representing the quantized audio data in the frame. A line equation common scalefactor value is determined from the first and second common scalefactor values.

22 Claims, 5 Drawing Sheets

METHOD AND APPARATUS FOR ENCODING AUDIO DATA

FIELD

An embodiment of the present invention relates to the field of encoders used for audio compression. More specifically, an embodiment of the present invention relates to a method and apparatus for the quantization of wideband, high fidelity audio data.

BACKGROUND

Audio compression involves the reduction of digital audio data to a smaller size for storage or transmission. Today, audio compression has many commercial applications. For example, audio compression is widely used in consumer electronics devices such as music, game, and digital versatile disk (DVD) players. Audio compression has also been used for distribution of audio data over the Internet, cable, satellite/terrestrial broadcast, and digital television.

Motion Picture Experts Group (MPEG) 2, and 4 Advanced Audio Coding (AAC), published October 2000 and March 2002 respectively, are well known compression standards that have emerged over the recent years. The quantization procedure used by MPEG 2, and 4 AAC can be described as having three major levels, a top level, an intermediate level, and a bottom level. The top level includes a "loop frame" that calls a subordinate "outer loop" at the intermediate level. The outer loop calls an "inner loop" at the bottom level. The quantization procedure iteratively quantizes an input vector and increases a quantizer incrementation size until an output vector can be successfully coded with an available number of bits. After the inner loop is completed, the outer loop checks the distortion of each spectral band. If the allowed distortion is exceeded, the spectral band is amplified and the inner loop is called again. The outer iteration loop controls the quantization noise produced by the quantization of the frequency domain lines within the inner iteration loop. The noise is colored by multiplying the lines within the spectral bands with actual scalefactors prior to quantization.

The calculation of bits required for representing quantized frequency lines and scalefactors is an operation that is frequently used and that requires significant time and computing resources. This process has been found to result in bottlenecks for audio encoding schemes such as MPEG 2, and 4 AAC. Thus, what is needed is a method and apparatus for efficiently searching common scalefactor values during quantization in order to reduce the number of times bit calculations are performed.

BRIEF DESCRIPTION OF THE DRAWINGS

The features and advantages of embodiments of the present invention are illustrated by way of example and are not intended to limit the scope of the embodiments of the present invention to the particular embodiments shown, and in which.

DETAILED DESCRIPTION

In the following description, for purposes of explanation, specific nomenclature is set forth to provide a thorough understanding of embodiments of the present invention. However, it will be apparent to one skilled in the art that these specific details may not be required to practice the embodiments of the present invention. In other instances, well-known circuits and devices are shown in block diagram form to avoid obscuring embodiments of the present invention.

Figure 1:
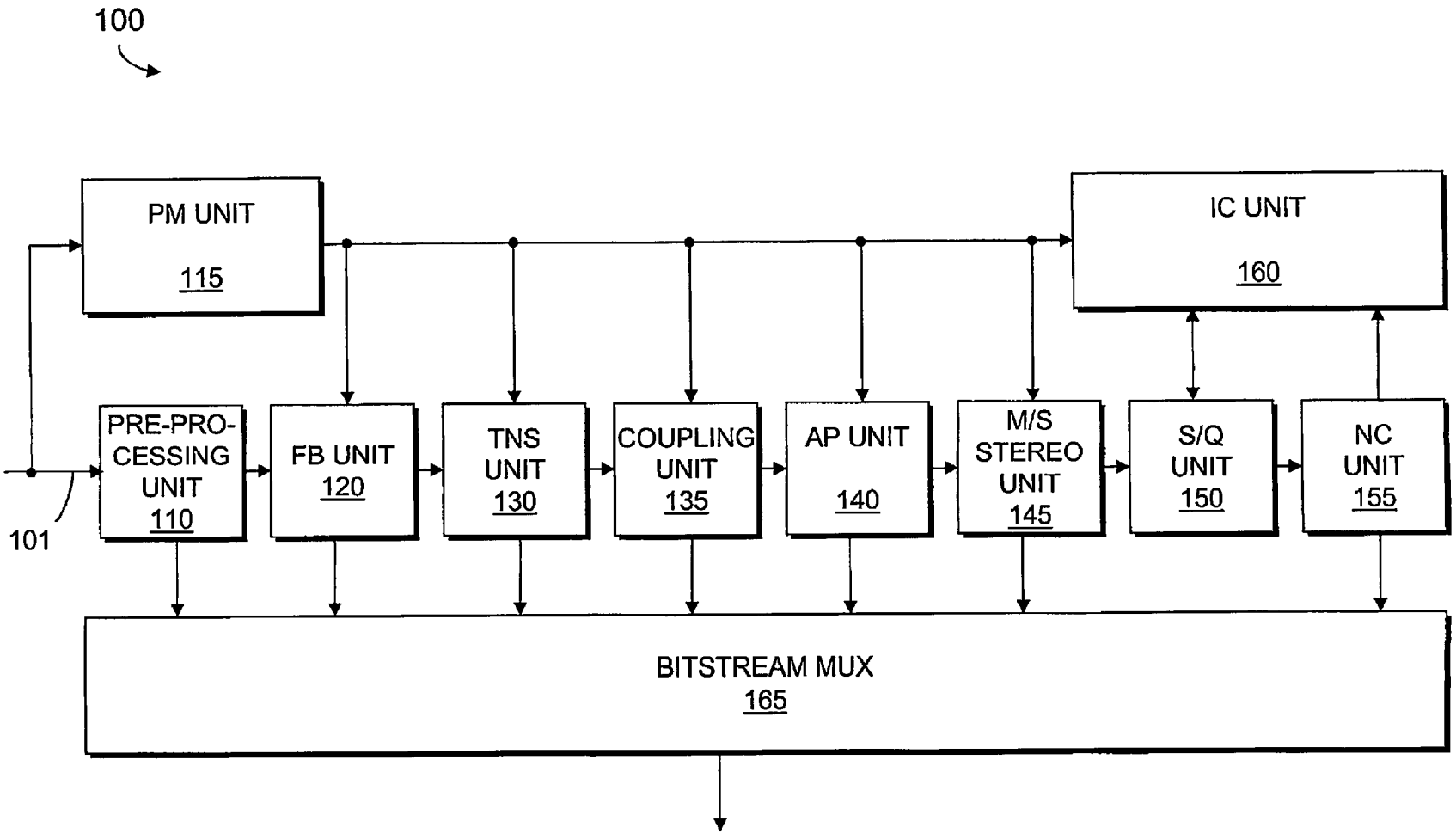
FIG. 1 is a block diagram of an audio encoder according to an embodiment of the present invention.

FIG. 1 is a block diagram of an audio encoder 100 according to an embodiment of the present invention. The audio encoder 100 includes a plurality of modules that may be implemented in software and reside in a main memory of a computer system (not shown) as sequences of instructions. Alternatively, it should be appreciated that the modules of the audio encoder 100 may be implemented as hardware or a combination of both hardware and software. The audio encoder 100 receives audio data from input line 101. According to an embodiment of the audio encoder 100, the audio data from the input line 101 is pulse code modulation (PCM) data.

The audio encoder 100 includes a pre-processing unit 110 and a perceptual model (PM) unit 115. The pre-processing unit 110 may operate to perform pre-filtering and other processing functions to prepare the audio data for transform. The perceptual model unit 115 operates to estimate values of allowed distortion that may be introduced during encoding. According to an embodiment of the perceptual model unit 115, a Fast Fourier Transform (FFT) is applied to frames of the audio data. FFT spectral domain coefficients are analyzed to determine tone and noise portions of a spectra to estimate masking properties of noise and harmonics of the audio data. The perceptual model unit 115 generates thresholds that represent an allowed level of introduced distortion for the spectral bands based on this information.

The audio encoder 100 includes a filter bank (FB) unit 120. The filter bank unit 120 transforms the audio data from a time to a frequency domain generating a set of spectral values that represent the audio data. According to an embodiment of the audio encoder 100, the filter bank unit 120 performs a modified discrete cosine transform (MDCT) which transforms each of the samples to a MDCT spectral coefficient. In one embodiment, each of the MDCT spectral coefficients is a single precision floating point value having 32 bits. According to an embodiment of the present invention, the MDCT transform is a 2048-points MDCT that produces 1024 MDCT coefficients from 2048 samples of input audio data. It should be appreciated that other transforms and other length coefficients may be generated by the filter bank unit 120.

The audio encoder includes a temporal noise shaping (TNS) unit 130 and a coupling unit 135. The temporal noise shaping unit 130 applies a smoothing filter to the MDCT spectral coefficients. The application of the smoothing filter allows quantization and compression to be more effective. The coupling unit 135 combines the high-frequency content of individual channels and sends the individual channel signal envelopes along the combined coupling channel. Coupling allows effective compression of stereo signals.

The audio encoder includes an adaptive prediction (AP) unit 140 and a mid/side (M/S) stereo unit 145. For quasi-periodical signals in the audio data, the adaptive prediction unit 140 allows the spectrum difference between frames of audio data to be encoded instead of the full spectrum of audio data. The M/S stereo unit 145 encodes the sum and differences of channels in the spectrum instead of the spectrum of left and right channels. This also improves the effective compression of stereo signals.

The audio encoder 100 includes a scaler/quantizer (S/Q) unit 150, noiseless coding (NC) unit 155, and iterative control (IC) unit 160. The scaler/quantizer unit 150 operates to generate scalefactors and quantized MDCT values to represent the MDCT spectral coefficients with allowed bits. The scalefactors include a common scale factor value that is applied to all spectral bands and individual scale factor values that are applied to specific spectral bands. According to an embodiment of the present invention, the scaler/quantizer unit 150 initially selects the common scalefactor value generated for the previous frame of audio data as the common scalefactor value for a current frame of audio data.

The noiseless coding unit 155 finds a set of codes to represent the scalefactors and quantized MDCT values. According to an embodiment of the present invention, the noiseless coding unit 155 utilizes Huffman code (variable length code (VLC) table). The number of bits required to represent the scalefactors and the quantized MDCT values are counted. The scaler/quantizer unit 150 adjusts the common scalefactor value by using Newton's method to determine a line equation common scalefactor value that may be designated as the common scalefactor value for the frame of audio data.

The iterative control unit 160 determines whether the common scalefactor value needs to be further adjusted and the MDCT spectral coefficients need to be re-quantized in response to the number of bits required to represent the common scalefactor value and the quantized MDCT values. The iterative control unit 160 also modifies the individual scalefactor values for spectral bands with distortion that exceed the thresholds determined by the perceptual model unit 110. Upon modifying an individual scalefactor value, the iterative control unit 160 determines that the common scalefactor value needs to be further adjusted and the MDCT spectral coefficients need to be re-quantized.

The audio encoder 100 includes a bitstream multiplexer 165 that formats a bitstream with the information generated from the pre-processing unit 110, perceptual model unit 115, filter bank unit 120, temporal noise shaping unit 130, coupling unit 135, adaptive prediction unit 140, M/S stereo unit 145, and noiseless coding unit 155.

The pre-processing unit 110, perceptual model unit 115, filter bank unit 120, temporal noise shaping unit 130, coupling unit 135, adaptive prediction unit 140, M/S stereo unit 145, scaler/quantizer unit 150, noiseless coding unit 155, iterative control unit 160, and bitstream multiplexer 165 may be implemented using any known circuitry or technique. It should be appreciated that not all of the modules illustrated in FIG. 1 are required for the audio encoder 100. According to a hardware embodiment of the audio encoder 100, any and all of the modules illustrated in FIG. 1 may reside on a single semiconductor substrate.

Figure 2:
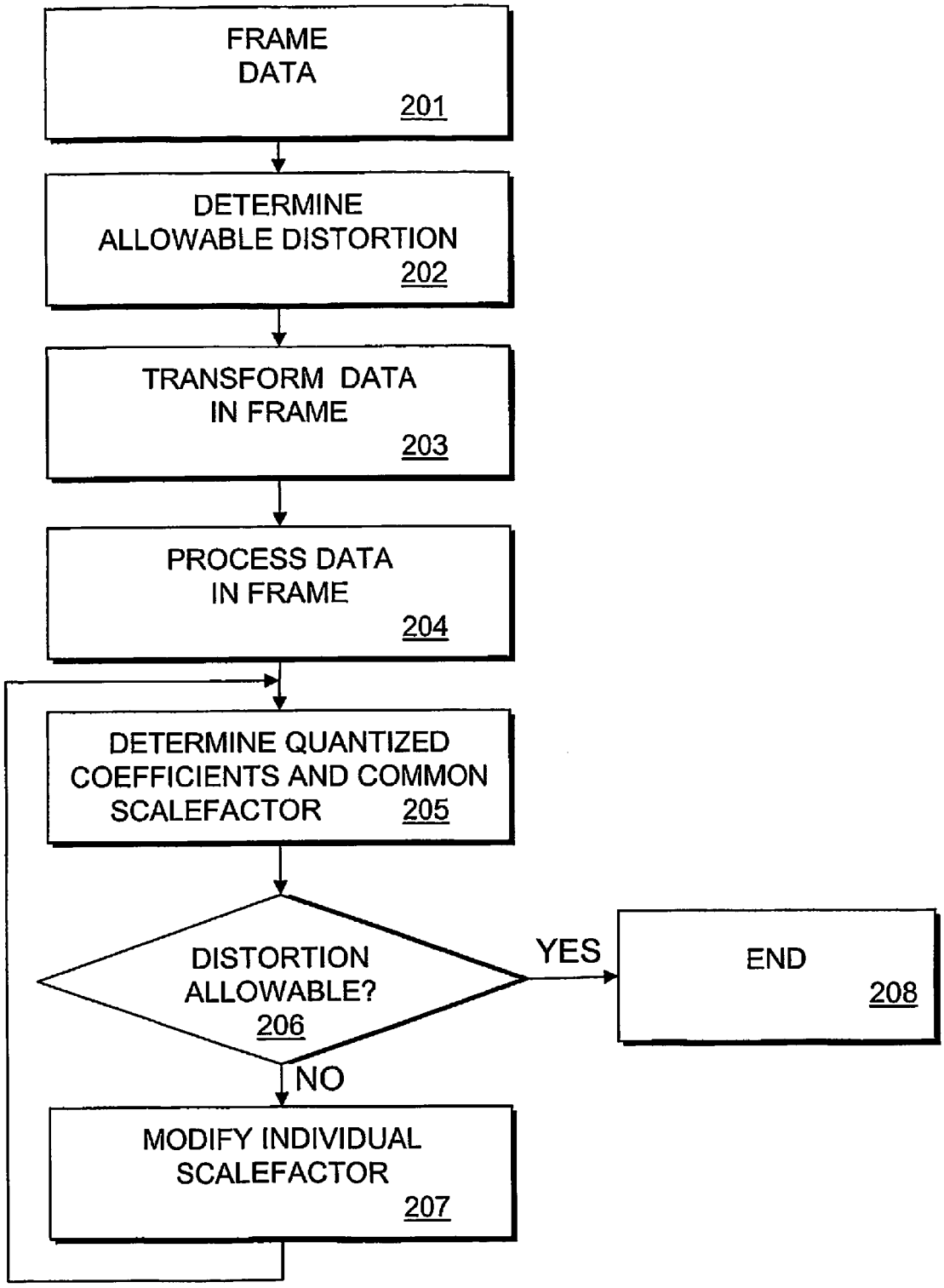
FIG. 2 is a flow chart illustrating a method for performing audio encoding according to an embodiment of the present invention.

FIG. 2 is a flow chart illustrating a method for performing audio encoding according to an embodiment of the present invention. At 201, input audio data is placed into frames. According to an embodiment of the present invention, the input data may include a stream of samples having 16 bits per value at a sampling frequency of 44100 Hz. In this embodiment, the frames may include 2048 samples per frame.

At 202, the allowable distortion for the audio data is determined. According to an embodiment of the present invention, the allowed distortion is determined by using a psychoacoustic model to analyze the audio signal and to compute an amount of noise masking available as a function of frequency. The allowable distortion for the audio data is determined for each spectral band in the frame of audio data.

At 203, the frame of audio data is processed by performing a time to frequency domain transformation. According to an embodiment of the present invention, the time to frequency transformation transforms each frame to include 1024 single precision floating point MDCT coefficients, each having 32 bits.

At 204, the frame of audio data may optionally be further processed. According to an embodiment of the present invention, further processing may include performing intensity stereo (IS), mid/side stereo, temporal noise shaping, perceptual noise shaping (PNS) and/or other procedures on the frame of audio data to improve the condition of the audio data for quantization.

At 205, quantized MDCT values are determined for the frame of audio data. Determining the quantized MDCT values is an iterative process where the common scalefactor value is modified to allow the quantized MDCT values to be represented with available bits determined by a bit rate. According to an embodiment of the present invention, the common scale factor value determined for a previous frame of audio data is selected as an initial common scale factor value the first time 205 is performed on the current frame of audio data. According to an embodiment of the present invention, the common scale factor value may be modified by using Newton's method to determine a line equation common scalefactor value that may be designated as the common scalefactor value for the frame of audio data.

At 206, the distortion in frame of audio data is compared with the allowable distortion. If the distortion in the frame of audio data is within the allowable distortion determined at 202, control proceeds to 208. If the distortion in the frame of audio data exceeds the allowable distortion, control proceeds to 207.

At 207, the individual scalefactor values for spectral bands having more than the allowable distortion is modified to amplify those spectral bands. Control proceeds to 205 to recompute the quanitized MDCT values and common scalefactor value in view of the modified individual scalefactor values.

At 208, control terminates the process.

Figure 3:
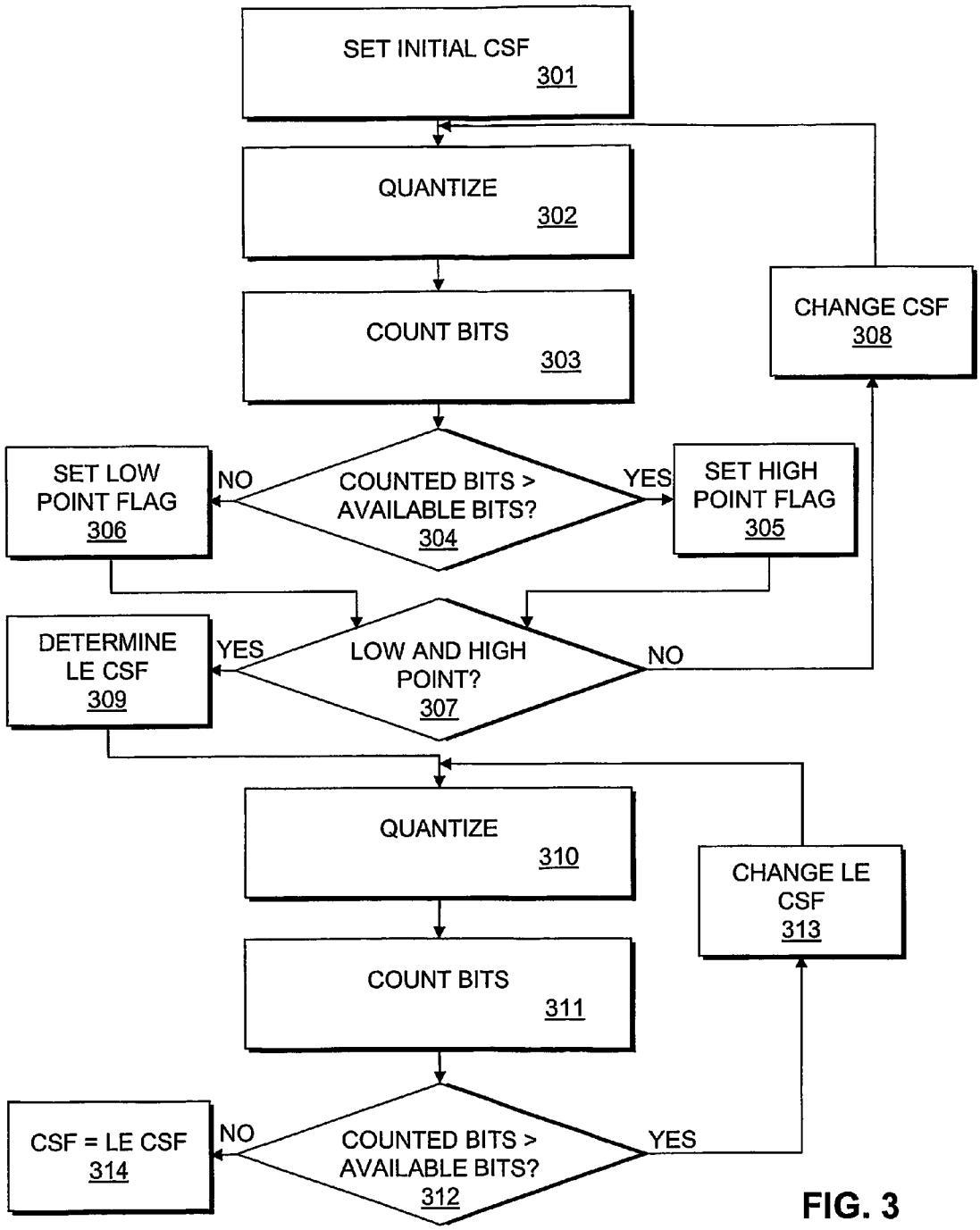
FIG. 3 is a flow chart illustrating a method for determining quantized modified discrete cosine transform values and a common scalefactor value for a frame of audio data according to an embodiment of the present invention.

FIG. 3 is a flow chart illustrating a method for determining quantized MDCT values and a common scalefactor value for a frame of audio data according to an embodiment of the present invention. The method described in FIG. 3 may be used to implement 205 of FIG. 2. At 301, the common scalefactor value (CSF) determined for a previous frame of audio data is set as the initial common scalefactor value for the current frame of data.

At 302, MDCT spectral coefficients are quantized to form quantized MDCT values. According to an embodiment of the present invention, the MDCT spectral coefficients for each spectral band are first scaled by performing the operation shown below where mdct_line(i) represents a MDCT spectral coefficient having index i of a spectral band and mdct_scaled (i) represents a scaled representation of the MDCT spectral coefficient and where the individual scalefactor for each spectral band is initially set to zero.

$$mdct_\text{scaled}(i)=abs(mdct_\text{line}(i))^{3/4}*2^{(3/16*ind\ scalefactor(spectral\ band))} \quad (1)$$

The quantized MDCT values are generated from the scaled MDCT spectral coefficients by performing the following operation, where x_quant(i) represents the quantized MDCT value.

$$x_quant(i)=int((mdct_\text{scaled}(i)*2^{(-3/16*common\ scalefactor\ value)})+\text{constant}) \quad (2)$$

At 303, the bits required for representing the quantized MDCT values and the scalefactors are counted. According to an embodiment of the present invention, noiseless encoding functions are used to determine the number of bits required for representing the quantized MDCT values and scalefactors ("counted bits"). The noiseless encoding functions may utilize Huffman coding (VLC) techniques.

At 304, it is determined whether the counted bits number exceeds the number of available bits. The number of available bits are the number of available bits to conform with a predefined bit rate. If the number of counted bits exceeds the number of available bits, control proceeds to 305. If the number of counted bits does not exceed the number of available bits, control proceeds to 306.

At 305, a flag is set indicating that a high point for the common scalefactor value has been determined. The high point represents a common scalefactor value having an associated number of counted bits that exceeds the number of available bits. Control proceeds to 307.

At 306, a flag is set indicating that a low point for the common scalefactor value has been determined. The low point represents a common scalefactor value having an associated number of counted bits that does not exceed the number of available bits. Control proceeds to 307.

At 307, it is determined whether a high point and a low point have been determined for the common scalefactor value. If both a high point and a low point have not been determined, control proceeds to 308. If both a high point and a low point have been determined, control proceeds to 309.

At 308, the common scalefactor is modified. If the number of counted bits is less than the available bits and only a low point has been determined, the common scalefactor value is decreased. If the number of counted bits is more than the available bits and only a high point has been determined, the common scalefactor value is increased. According to an embodiment of the present invention, the quanitzer change value (quantizer incrementation) to modify the common scalefactor value is 16. It should be appreciated that other values may be used to modify the common scalefactor value. Control proceeds to 302.

At 309, a line equation common scalefactor value is calculated. According to an embodiment of the present invention, the line equation common scalefactor value is calculated using Newton's method (line equation). Because the number of bits required to represent the quantized MDCT values and the scalefactors for a frame of audio data is often linearly dependent to its common scalefactor value, an assumption is made that there exists a first common scalefactor value and a second common scalefactor value that respective first counted bits and second counted bits satisfy the inqualities: first counted bits<available bits<second counted bits. Using this line equation, a common scalefactor value can be computed that is near optimal given its linear dependence to counted bits.

The first common scalefactor value may be set to the common scalefactor value determined for the previous frame of audio data. Depending on the value of the first counted bits, the second common scalefactor value is modified by either adding or subtracting a quantizer change value. The line equation common scalefactor value may be determined by using the following relationship.

$$(\text{line eq. CSF value}-\text{first CSF value})/(\text{second CSF}-\text{line eq. CSF})=(\text{first counted bits}-\text{available bits})/(\text{available bits}-\text{second counter bits}) \quad (3)$$

According to an embodiment of the present invention, the first and second common scalefactor values may represent common scalefactor values associated with numbers of counted bits that exceed and do not exceed the number of allowable bits. It should be appreciated however, that a line equation common scalefactor value may be calculated with two common scalefactor values associated with numbers of counted bits that both exceed or both do not exceed the number of allowable bits. In this embodiment, 304-307 may be replaced with a procedure that insures that two common scalefactor values are determined.

Figure 4:
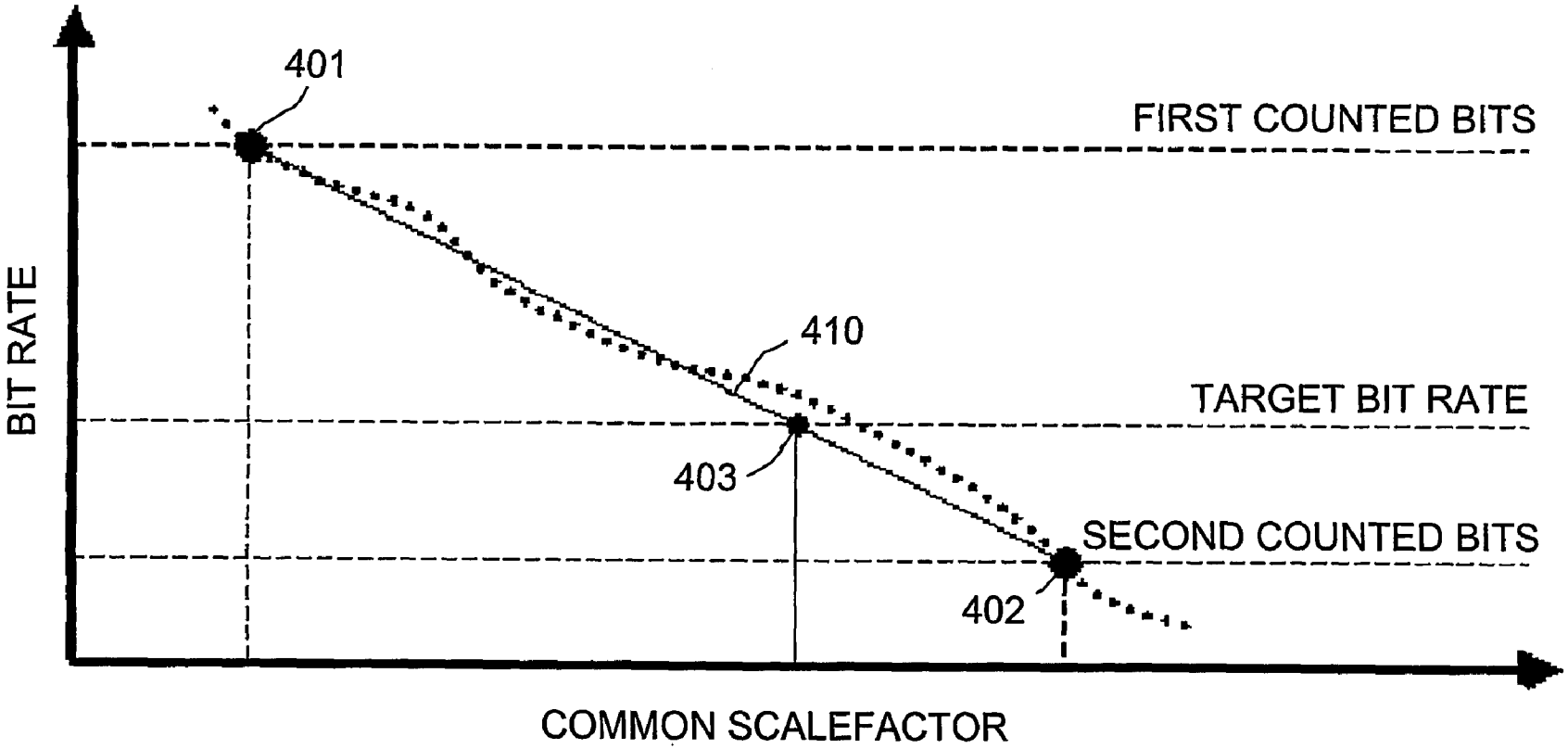
FIG. 4 illustrates Newton's method applied to performing a common scalefactor value search.

FIG. 4 illustrates Newton's method applied to perform a common scalefactor value search. A first common scalefactor value 401 and a second common scalefactor value 402 are determined on a quasi straight line 410 representing counted bits on common scalefactor dependency. The intersection of the target bit rate value (available bits) line provides the line equation common scalefactor value 403.

Referring back to FIG. 3, at 310, MDCT spectral coefficients are quantized using the line equation common scalefactor value to form quantized MDCT values. This may be achieved as described in 302.

At 311, the bits required for representing the quantized MDCT values and the scalefactors are counted. This may be achieved as described in 303.

At 312, it is determined whether the number counted bits exceed the number of available bits. The number of available bits are the number of available bits to conform with a predefined bit rate. If the number of counted bits exceeds the number of available bits, control proceeds to 313. If the number of counted bits does not exceed the number of available bits, control proceeds to 314.

At 313, the line equation common scalefactor value is modified. According to an embodiment of the present invention, the quantizer change value that is used is smaller than the one used in 308. In one embodiment a value of 1 is added to the line equation common scalefactor value. Control proceeds to 310.

At 314, the line equation common scalefactor value (LE CSF) is designated as the common scalefactor value for the frame of audio data control.

Figure 5:
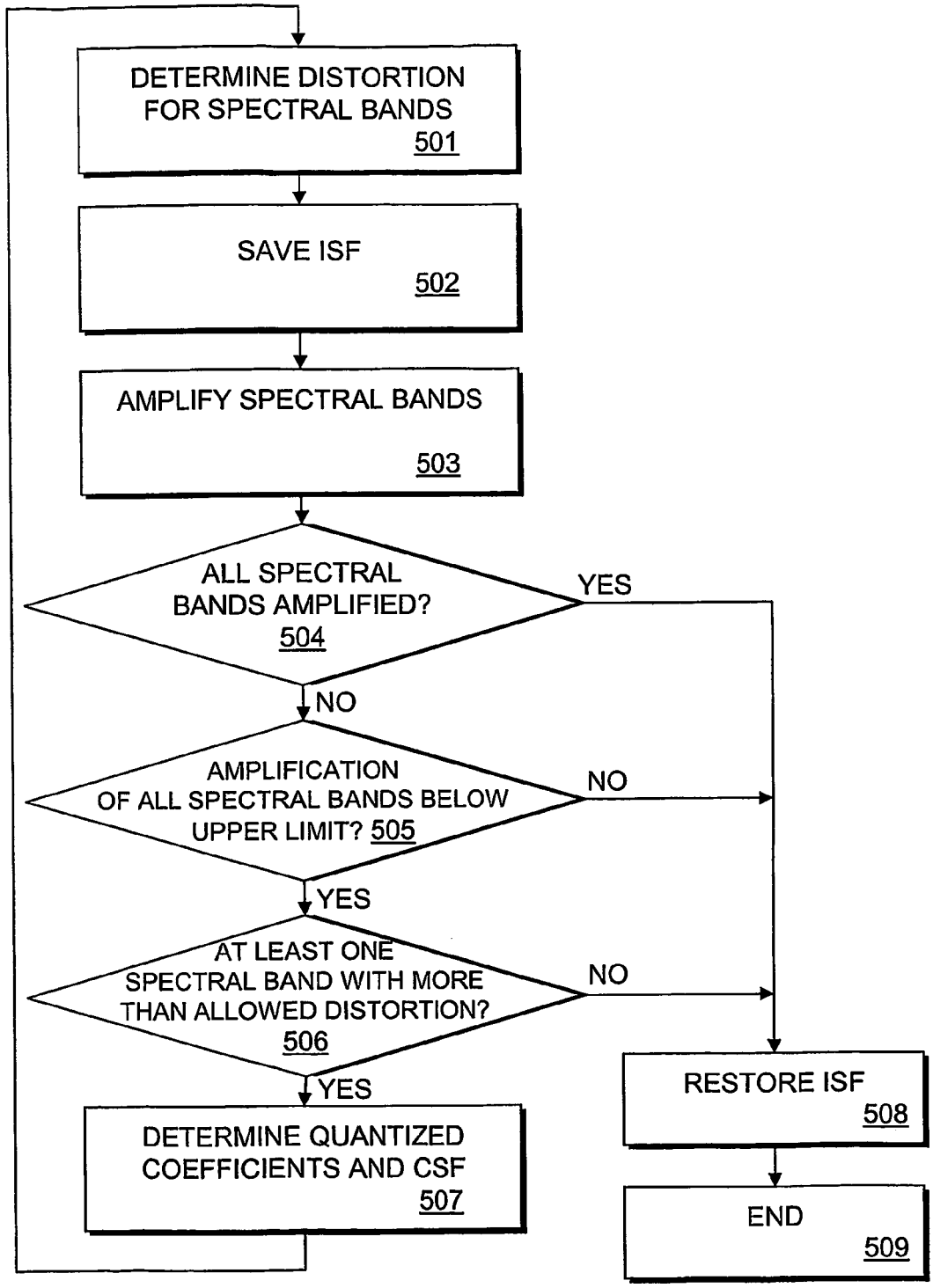
FIG. 5 is a flow chart illustrating a method for processing individual scalefactor values for spectral bands according to an embodiment of the present invention.

FIG. 5 is a flow chart illustrating a method for processing individual scalefactor values for spectral bands according to an embodiment of the present invention. According to an embodiment of the present invention, the method illustrated in FIG. 5 may be used to implement 206 and 207 of FIG. 2. At 501, the distortion is determined for each of the spectral bands in the frame of audio data. According to an embodiment of the present invention, the distortion for each spectral band may be determined from the following relationship where error_energy(sb) represents distortion for spectral band sb.

$$\text{error_energy}(sb)=\Sigma_{(for\ all\ indices\ i)}(abs(mdct_\text{line}(i)-(x_\text{quant}(i)^{4/3}*2^{(-1/4*(scalefactor(sb)-common\ scalefactor))})))^2 \quad (4)$$

At 502, the individual scalefactor values (ISF) for each of the spectral bands are saved.

At 503, each of the spectral bands with more than the allowed distortion is amplified. According to an embodiment of the present invention, a spectral band is amplified by increasing the individual scalefactor value associated with the spectral band by 1.

At 504, it is determined whether all of the spectral bands have been amplified. If all of the spectral bands have been amplified, control proceeds to 508. If not all of the spectral bands have been amplified, control proceeds to 505.

At 505, it is determined whether amplification of all spectral bands has reached an upper limit. If amplification of all spectral bands (SB) has reached an upper limit, control proceeds to 506. If amplification of all spectral bands has not reached an upper limit, control proceeds to 508.

At 506, it is determined whether at least one spectral band has more than the allowed distortion. If at least one spectral band has more than the allowed distortion, control proceeds to 507. If none of the spectral bands has more than the allowed distortion, control proceeds to 508.

At 507, quantized MDCT values and a common scalefactor value are determined for the current frame of audio data in view of the modified individual scalefactor values. According to an embodiment of the present invention, quantized MDCT values and the common scalefactor value may be determined by using the method described in FIG. 4.

At 508, the individual scalefactor values for the spectral bands are restored. According to an embodiment of the present invention, the individual scalefactor values for the spectral bands are restored to the values saved at 502.

At 509, control terminates the process.

FIGS. 2, 3, and 5 are flow charts illustrating a method for performing audio encoding, a method for determining quantized MDCT values and a common scalefactor value for a frame of audio data, and a method for processing individual scalefactor values for spectral bands according to embodiments of the present invention. Some of the procedures illustrated in the figures may be performed sequentially, in parallel or in an order other than that which is described. It should be appreciated that not all of the procedures described are required, that additional procedures may be added, and that some of the illustrated procedures may be substituted with other procedures.

The described method for performing audio encoding reduces the time required for determining the common scalefactor value for a frame of audio data. The method for determining quantized MDCT values and common scalefactor value described with reference to FIG. 3 may be used to implement the inner loop of coding standards such as MPEG 2, and 4 AAC in order to reduce convergence time and reduce the number of times calculating or counting the bits used for representing quantized frequency lines and scalefactors is performed. Faster encoding allows the processing of more audio channels simultaneously in real time. It should be appreciated that the techniques described may also be applied to improve the efficiency of other coding standards.

The techniques described herein are not limited to any particular hardware or software configuration. They may find applicability in any computing or processing environment. The techniques may be implemented in hardware, software, or a combination of the two. The techniques may be implemented in programs executing on programmable machines such as mobile or stationary computers, personal digital assistants, set top boxes, cellular telephones and pagers, and other electronic devices, that each include a processor, a storage medium readable by the processor (including volatile and non-volatile memory and/or storage elements). One of ordinary skill in the art may appreciate that the embodiments of the present invention can be practiced with various computer system configurations, including multiprocessor systems, minicomputers, mainframe computers, and other systems. The embodiments of the present invention can also be practiced in distributed computing environments where tasks may be performed by remote processing devices that are linked through a communications network.

Program instructions may be used to cause a general-purpose or special-purpose processing system that is programmed with the instructions to perform the operations described herein. Alternatively, the operations may be performed by specific hardware components that contain hardwired logic for performing the operations, or by any combination of programmed computer components and custom hardware components. The methods described herein may be provided as a computer program product that may include a machine readable medium having stored thereon instructions that may be used to program a processing system or other electronic device to perform the methods. The term "machine readable medium" used herein shall include any medium that is capable of storing or encoding a sequence of instructions for execution by the machine and that cause the machine to perform any one of the methods described herein. The term "machine readable medium" shall accordingly include, but not be limited to, solid-state memories, optical and magnetic disks, and a carrier wave that encodes a data signal. Furthermore, it is common in the art to speak of software, in one form or another (e.g., program, procedure, process, application, module, logic, and so on) as taking an action or causing a result. Such expressions are merely a shorthand way of stating that the execution of the software by a processing system causes the processor to perform an action to produce a result.

In the foregoing specification the embodiments of the present invention have been described with reference to specific exemplary embodiments thereof. It will, however, be evident that various modifications and changes may be made thereto without departing from the broader spirit and scope of the embodiments of the present invention. The specification and drawings are, accordingly, to be regarded in an illustrative rather than restrictive sense.

What is claimed is:

1. An audio encoder circuit, comprising:

a scaler/quantizer unit to determine a first common scalefactor value for representing quantized audio data in a frame, a second common scalefactor value for representing the quantized audio data in the frame, and a line equation common scalefactor value from the first and second common scalefactor values; and a noiseless coding unit to receive the line equation common scalefactor.

2. The audio encoder circuit of claim 1, wherein the first common scalefactor value represents a high point where a number of bits required to represent the quantized audio data with the first common scalefactor value exceeds a number of available bits, and the second common scalefactor value represents a low point where a number of bits required to represent the quantized audio data with the second common scalefactor value does not exceed the number of available bits.

3. The audio encoder circuit of claim 1, wherein determining the first common scalefactor value for representing the quantized audio data in the frame comprises determining a common scalefactor value for representing quantized audio data in a previous frame.

4. The audio encoder circuit of claim 1, wherein the noiseless coding unit determines a number of bits required for representing audio data in the frame quantized using the line equation common scalefactor value and a number of bits required for representing the line equation common scalefactor value.

5. The audio encoder circuit of claim 4, further comprising an iterative control unit to direct modification of the line equation common scalefactor value and re-quantization of the audio data in the frame with the modified line equation common scalefactor value if the number of bits required exceeds an available number of bits.

6. The audio encoder circuit of claim 5, wherein the scaler/quantizer unit designates the line equation common scalefactor value as the common scalefactor value for representing the audio data in the frame.

7. The audio encoder circuit of claim 6, wherein the iterative control unit determines distortion for each spectral band in the audio data of the frame; and directs modification of an individual scalefactor value corresponding to a spectral band if distortion for the spectral band exceeds allowed distortion.

8. The audio encoder circuit of claim 1, wherein a common scalefactor value from a previous frame is selected as the first common scalefactor value for the frame.

9. An audio encoder circuit, comprising:

a scaler/quantizer unit to determine a first common scalefactor value for representing quantized audio data in a first frame, and a second common scalefactor value for representing quantized audio data in a second frame in response to the first common scalefactor value for the first frame, wherein the scaler/quantizer unit quantizes modified discrete cosine transform (MDCT) coefficients with a common scalefactor value having a value of the first common scalefactor value determined for the first frame;

a noiseless coding unit to determine a number of bits required for representing the quantized MDCT coefficients and the common scalefactor value; and an iterative control unit to determine whether to modify the common scalefactor value and re-quantize the MDCT coefficients with the modified common scalefactor when the number of bits required exceeds an available number of bits.

10. The audio encoder circuit of claim 9, wherein the iterative control unit and scaler/quantizer unit effectuates modifying the common scalefactor value and re-quantizing the MDCT coefficients until the number of bits required is less than or equal to the available number of bits.

11. The audio encoder circuit of claim 9, wherein modifying the common scalefactor value comprises adding a quantizer incrementation value to the common scalefactor value.

12. An audio encoder circuit, comprising:

a scaler/quantizer unit to determine a first common scalefactor value for representing quantized audio data in a first frame, and a second common scalefactor value for representing quantized audio data in a second frame in response to the first common scalefactor value for the first frame, wherein the scaler/quantizer unit quantizes modified discrete cosine transform (MDCT) coefficients with a common scalefactor value having a value of the first common scalefactor value determined for the first frame and modifying the common scale factor value and re-quantizing the MDCT coefficients with the modified common scalefactor value, and determines a line equation common scalefactor value with the common scalefactor value and the modified common scalefactor value.

13. The audio encoder circuit of claim 12, wherein the common scalefactor value and the modified common scalefactor value represent low and high points.

14. The audio encoder circuit of claim 12 further comprising:

a noiseless coding unit to determine a number of bits required for representing MDCT coefficients quantized using the line equation common scalefactor value and a number of bits required for representing the line equation common scalefactor value; and an iterative control unit to direct modification of the line equation common scalefactor value and to direct re-quantization of the MDCT coefficients with the modified line equation common scalefactor value if the number of bits required, exceeds an available number of bits.

15. The audio encoder circuit of claim 14, wherein the scaler/quantizer unit designates the line equation common scalefactor value as the second common scalefactor value for representing the quantized audio data in the second frame.

16. The audio encoder circuit of claim 14, wherein the iterative control unit determines distortion for each spectral band in the second frame and directs modification of an individual scalefactor value corresponding to a spectral band if distortion in the spectral band exceeds allowed distortion.

17. A non-transitory storage medium having stored thereon sequences of instructions, the sequences of instructions including instructions which, when executed by a processor, causes the processor to perform:

determining a first common scalefactor value for representing quantized audio data in a frame;

determining a second common scalefactor value for representing the quantized audio data in the frame; and determining a line equation common scalefactor value from the first and second common scalefactor values.

18. The non-transitory storage medium of claim 17, wherein the first common scalefactor value represents a high point where a number of bits required to represent the quantized audio data with the first common scalefactor value exceeds a number of available bits, and the second common scalefactor value represents a low point where a number of bits required to represent the quantized audio data with the second common scalefactor value does not exceed the number of available bits.

19. The non-transitory storage medium of claim 17, wherein determining the first common scalefactor value for representing the quantized audio data in the frame comprises determining a common scalefactor value for representing quantized audio data in a previous frame.

20. The non-transitory storage medium of claim 17, further comprising instructions which, when executed by the processor, causes the processor to perform:

quantizing the audio data in the frame with the line equation common scalefactor value;

determining a number of bits required for representing the quantized audio data in the frame and the line equation common scalefactor value; and modifying the line equation common scalefactor value and re-quantizing the audio data in the frame with the modified line equation common scalefactor value if a number of bits required exceeds an available number of bits.

21. The non-transitory storage medium of claim 20, further comprising instructions which, when executed by the processor, causes the processor to perform designating the line equation common scalefactor value as the common scalefactor value for representing the audio data in the frame.

22. The non-transitory storage medium of claim 21, further comprising instructions which, when executed by the processor, causes the processor to perform:

determining distortion for each spectral band in the audio data of the frame; and modifying an individual scalefactor value corresponding to a spectral band if distortion for the spectral band exceeds allowed distortion.

* * * * *